US008403448B2

(12) United States Patent
Yasukawa et al.

(10) Patent No.: US 8,403,448 B2
(45) Date of Patent: Mar. 26, 2013

(54) MEDIUM TRANSPORT DEVICE, CONTROL PROGRAM FOR MEDIUM TRANSPORT DEVICE AND CONTROL METHOD FOR MEDIUM TRANSPORT DEVICE

(75) Inventors: Kaoru Yasukawa, Kanagawa (JP); Koji Adachi, Kanagawa (JP); Norikazu Yamada, Kanagawa (JP); Koki Uwatoko, Kanagawa (JP); Tetsuichi Satonaga, Kanagawa (JP); Shigehiro Furukawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 474 days.

(21) Appl. No.: 12/552,695

(22) Filed: Sep. 2, 2009

(65) Prior Publication Data

US 2010/0123285 A1 May 20, 2010

(30) Foreign Application Priority Data

Nov. 20, 2008 (JP) ..... 2008-296574

(51) Int. Cl.
*B41J 29/38* (2006.01)
*B65H 7/02* (2006.01)

(52) U.S. Cl. ..... 347/16; 271/259

(58) Field of Classification Search ..... 347/16, 347/104; 271/259
See application file for complete search history.

(56) References Cited

U.S. PATENT DOCUMENTS 3,204,950 A * 9/1965 Hanchett, Jr. ..... 271/259
4,310,153 A * 1/1982 Kikuchi ..... 271/259
6,481,705 B1 * 11/2002 Okada ..... 271/4.03

FOREIGN PATENT DOCUMENTS

JP A-08-085671 4/1996
JP A-2002-351251 12/2002

* cited by examiner

*Primary Examiner* — Julian Huffman
(74) *Attorney, Agent, or Firm* — Oliff & Berridge, PLC

(57) ABSTRACT

A medium transport device includes a sensor unit, a timing data collection unit, and a sampling resolution changing unit. The sensor unit is provided in a transport path of a print recording medium to detect a transport timing of the print recording medium. A timing data collection unit receives an output from the sensor unit and samples the output at a sampling interval as timing data. A sampling resolution changing unit changes the sampling interval.

7 Claims, 8 Drawing Sheets

100

MEDIUM TRANSPORT DEVICE, CONTROL PROGRAM FOR MEDIUM TRANSPORT DEVICE AND CONTROL METHOD FOR MEDIUM TRANSPORT DEVICE

CROSS-REFERENCE TO RELATED APPLICATIONS

This application is based on and claims priority under 35 USC 119 from Japanese Patent Application No. 2008-296574, filed on Nov. 20, 2008.

BACKGROUND

1. Technical Field

The present invention relates to a medium transport device, a control program for the medium transport device and a control method for the medium transport device.

2. Related Art

In an image forming apparatus, such as a printer or the like, a print recording medium, such as a sheet or the like, is transported along a transport path in the apparatus. In the transport path, transport members, such as a feed roller and the like for transporting the print recording medium are disposed.

SUMMARY OF THE INVENTION

According to an aspect of the invention, there is provided a medium transport device includes a sensor unit, a timing data collection unit, and a sampling resolution changing unit. The sensor unit is provided in a transport path of a print recording medium to detect a transport timing of the print recording medium. A timing data collection unit receives an output from the sensor unit and samples the output at a sampling interval as timing data. A sampling resolution changing unit changes the sampling interval.

BRIEF DESCRIPTION OF THE SEVERAL VIEWS OF THE DRAWINGS

Exemplary embodiment(s) of the present invention will be described in detail based on the following figures, wherein.

DETAILED DESCRIPTION

<First Exemplary Embodiment>

Figure 1:
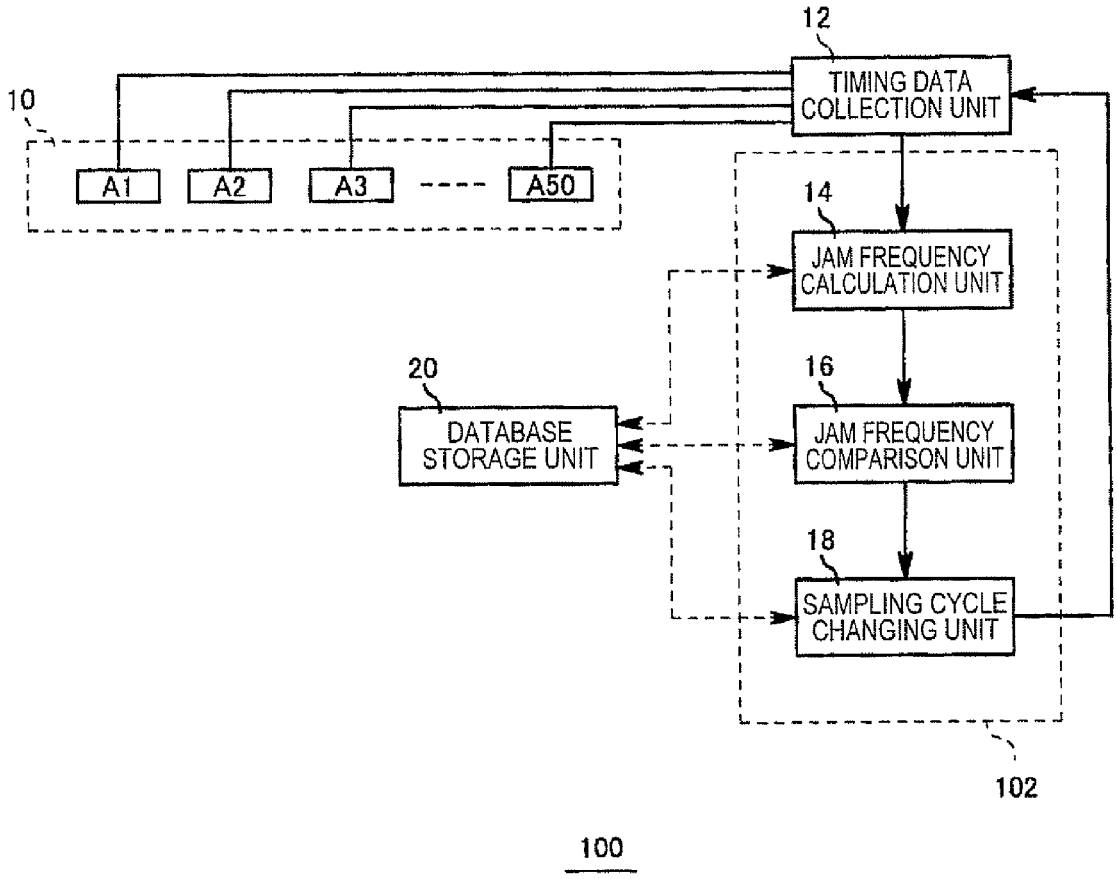
FIG. 1 is a diagram showing the configuration of a medium transport device according to a first exemplary embodiment.

As shown in FIG. 1, a medium transport device 100 according to a first exemplary embodiment includes a sensor 10, a timing data collection unit 12, a jam frequency calculation unit 14, a jam frequency comparison unit 16, a sampling interval changing unit 18, and a database storage unit 20. The medium transport device 100 is provided in an image forming apparatus, such as an electrophotographic print apparatus or the like, or a multi-function apparatus having the functions of a facsimile and a printer, or the like.

The jam frequency calculation unit 14, the jam frequency comparison unit 16, and the sampling interval changing unit 18 are included in the sampling resolution changing unit 102.

The timing data collection unit 12, the jam frequency calculation unit 14, the jam frequency comparison unit 16, the sampling interval changing unit 18, and the database storage unit 20 of the medium transport device 100 are realized by a computer which is provided in an image forming apparatus, such as an electrophotographic print apparatus or the like.

Figure 2:
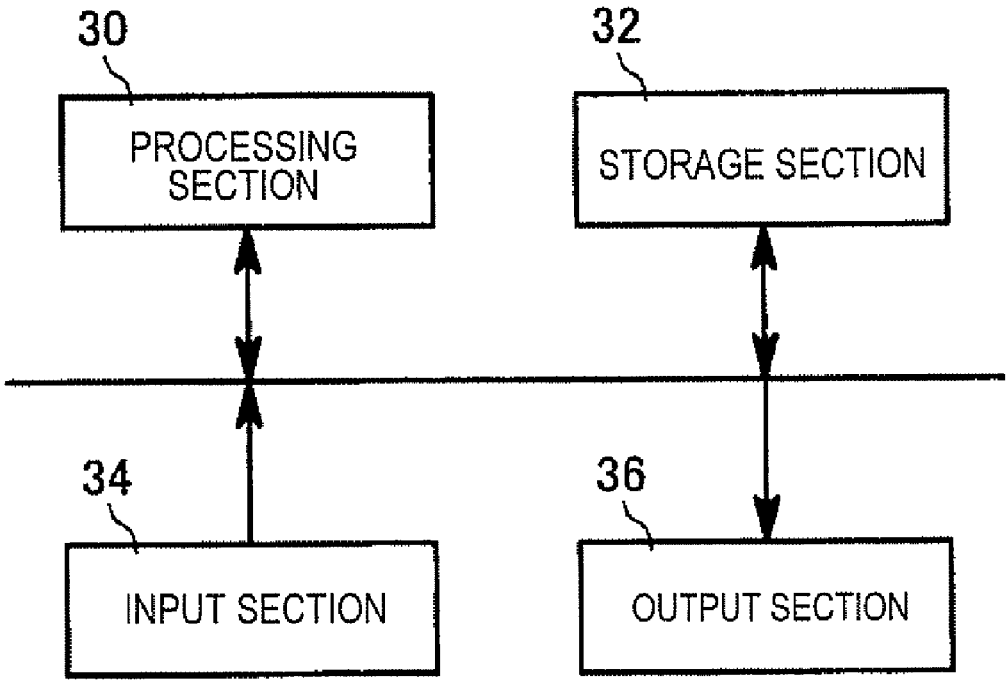
FIG. 2 is a diagram showing the configuration of a computer which realizes the medium transport device according to the first exemplary embodiment.

In general, as shown in FIG. 2, the computer includes a processing section (CPU) 30, a storage section 32, an input section 34, and an output section 36. The processing section 30 controls the function of the medium transport device 100 overall. The processing in the processing section 30 will be described below.

The storage section 32 stores and retains a control program or various kinds of data which are used in the medium transport device 100. The storage section 32 is appropriately accessed from the processing section 30.

The input section 34 receives the input of various kinds of parameters or the like which are used in the medium transport device 100. The input section 34 is, for example, a touch panel or the like provided in an image forming apparatus. A user of the medium transport device 100 sets parameters or input data necessary for control in the medium transport device 100 by using the input section 34.

The output section 36 displays various kinds of data which are presented to the user with regard to the processing in the medium transport device 100. The output section 36 is, for example, a touch panel or the like provided in an image forming apparatus. The user of the medium transport device 100 grasps the state of control in the medium transport device 100 on the basis of various kinds of information displayed by the output section 36.

Figure 3:
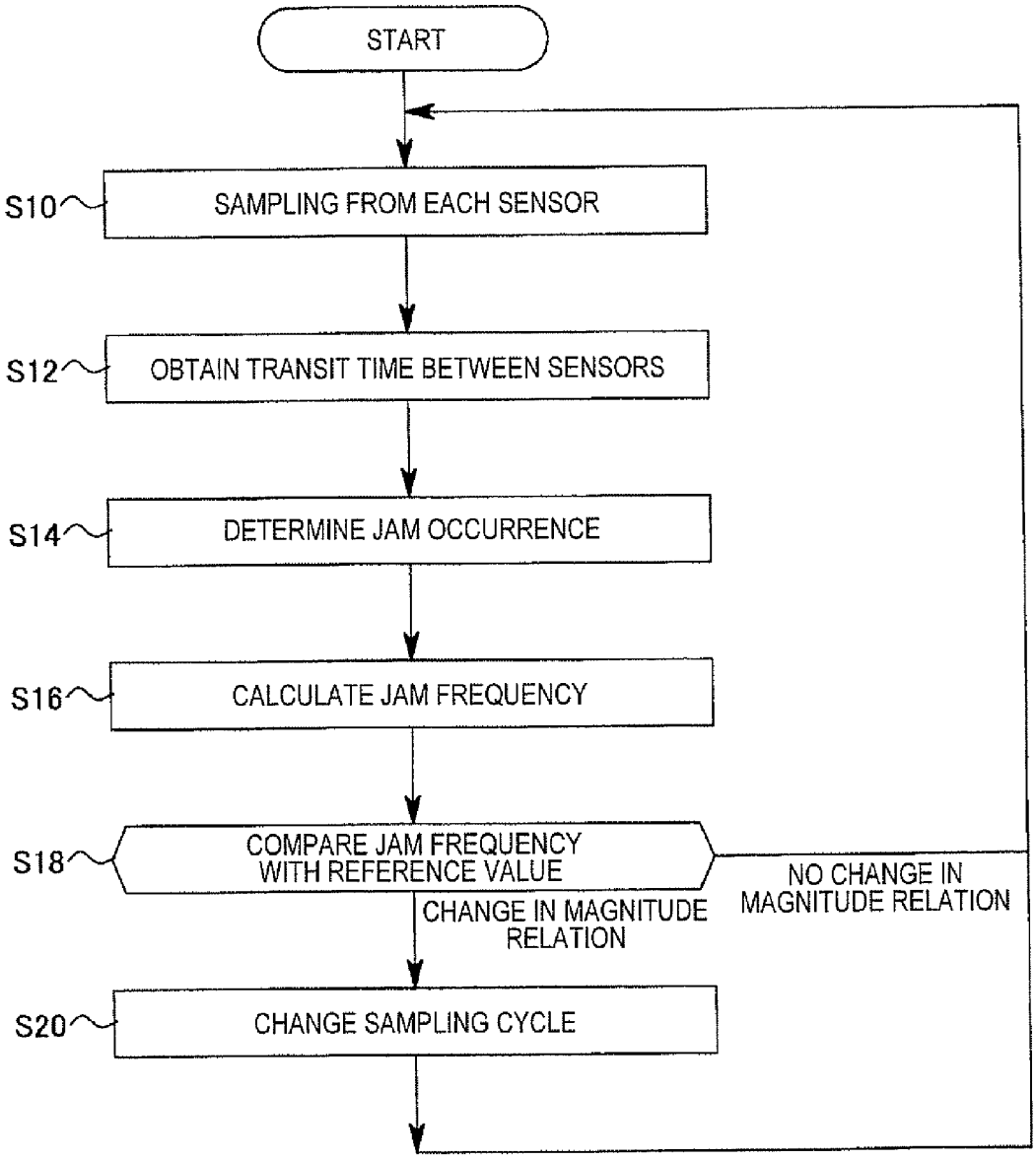
FIG. 3 is a flowchart showing a control method of the medium transport device according to the first exemplary embodiment.

Hereinafter, control in the medium transport device will be described with reference to a flowchart of a control method for the medium transport device of FIG. 3. The processing section 30 executes a control program for the medium transport device which is recorded in advance in the storage section 32 to perform the following processing, and thus the respective units shown in FIG. 1 are realized.

In Step S10, the output from the sensor 10 is sampled. The sensor 10 is disposed in the transport path of the print recording medium (for example, a sheet). At least one sensor 10 is provided, and in general, there are many cases where plural of sensors are provided in the transport path. In this exemplary embodiment, it is assumed that 50 sensors, a sensor 10 (A1) to a sensor 10 (A50), are provided.

The respective sensors 10 output signals indicating presence/absence of the print recording medium which passes through the respective sections in the transport path. The processing section 30 samples the signals output from the respective sensors 10.

For example, each sensor 10 changes the output from High to Low if the leading end of the sheet is detected, and changes the output from Low to High if the trailing end of the sheet is detected. The processing section 30 samples the signal output from each sensor 10. The processing section 30 samples the output from each sensor 10 at a sampling interval (time interval) set for each sensor 10, and samples the timing at which the print recording medium passes through the position where each sensor 10 is disposed in the transport path.

Figure 4:
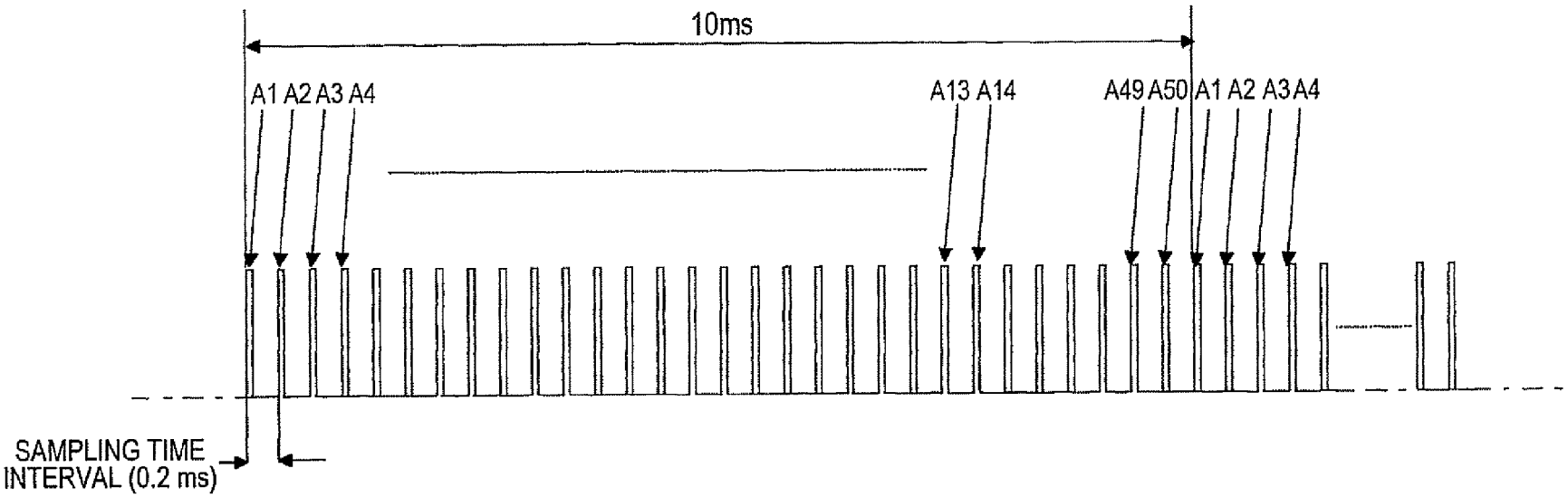
FIG. 4 is a diagram illustrating sampling of each sensor in an initial state.

For example, in the case of an initial setting, the outputs from the respective sensors 10 are sequentially sampled at an interval of 0.2 ms. As shown in FIG. 4, when 50 sensors 10 specified by symbols A1 to A50 are disposed, in an initial state, the outputs from the respective sensors 10 are sampled for every 0.2 ms×50=10 ms.

In Step S12, a time during which the print recording medium passes between the sensors 10 is calculated from the sampling signal from the respective sensor 10 obtained in Step S10. The processing section 30 calculates a time during which the print recording medium passes between two sensors 10 by using the outputs of the two sensors 10 which are disposed in the transport path. This step corresponds to the timing data collection unit 12.

Figure 5:
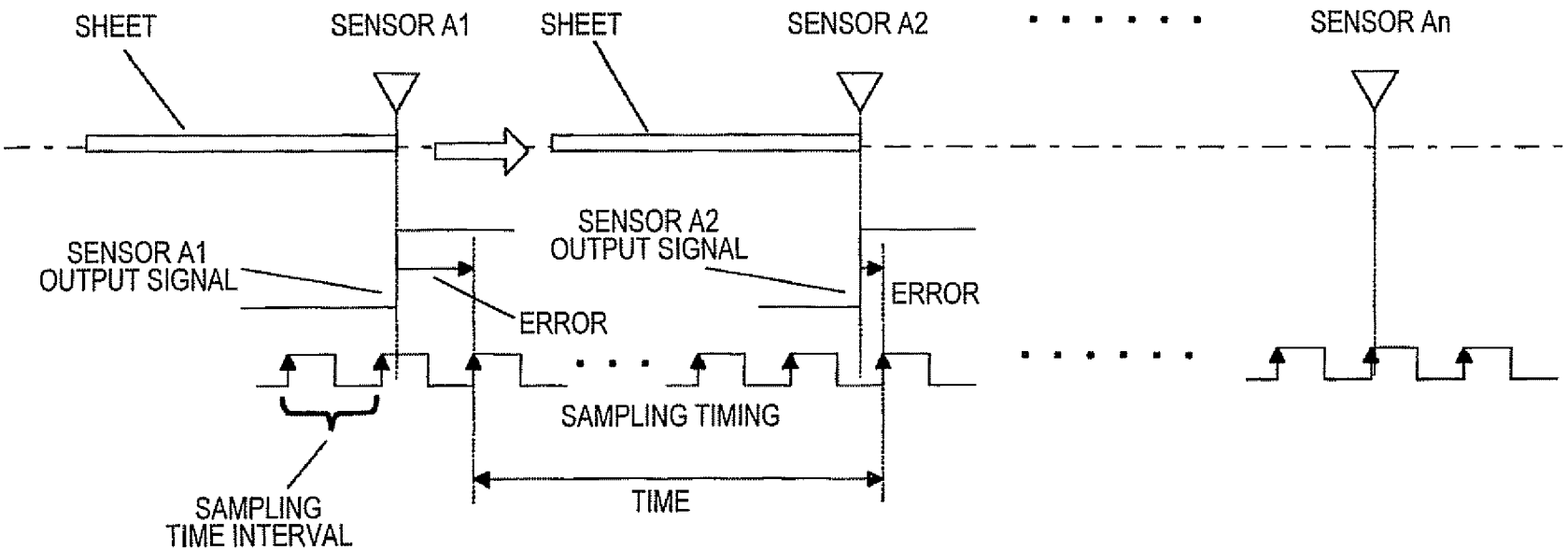
FIG. 5 is a diagram illustrating a transport time error.

For example, if the leading end of the sheet traverses the sensor 10 (A1), the output of the sensor 10 (A1) is changed from Low to High. Then, if the leading end of the sheet traverses the next sensor 10 (A2), the output of the next sensor 10 (A2) is changed from High to Low (FIG. 5). A time between the timing at which the output of the sensor 10 (A1) is changed from High to Low to the timing at which the output of the sensor 10 (A2) is changed from High to Low is measured by a counter or the like and obtained as timing data (sheet transport time) from the sensor 10 (A1) to the sensor 10 (A2). Similarly, the transport time of the print recording medium between two other prescribed sensors 10 may be obtained.

The timing at which the output from the sensor 10 is changed from High to Low may cause an error by the sampling interval (time interval) of each sensor 10. In the time measurement of the sheet which passes between the sensors 10, errors in the passing timing of two sensors 10 are summed, and accordingly the sum of the sampling time intervals of the respective sensors 10 may become the maximum error. For example, when the sampling interval of each sensor 10 is 10 ms in the initial state, the error in the sheet transport time between two sensors 10 becomes the maximum 20 ms.

In this exemplary embodiment, the sampling interval of each sensor 10 is changed by the sampling resolution changing unit 102 described below. Accordingly, when needed, the measurement error of the sheet transport time due to the sampling interval is reduced.

In Step S14, it is determined whether a jam of the print recording medium occurs in the transport path or not on the basis of the transport time obtained in Step S12.

The processing section 30 compares the transport time obtained in Step S12 with a jam time reference value which is registered in advance in the storage section 32 as a reference transport time database for each transport time, and when the transport time exceeds the reference value, determines that a jam has occurred in the relevant transport area. Otherwise, it is determined that no jam has occurred. The storage section 32 that stores the reference transport time database functions as a reference transport time database storage unit which is included in the database storage unit 20.

When it is determined that a jam has occurred, the processing section 30 stops sheet transport and displays the jam occurrence on a user interface screen of the output section 36 and a removal method for the print recording medium clogged in the transport path due to the jam.

In Step S16, an update processing of a jam history database is performed. When it is determined that a jam has occurred, the processing section 30 updates the jam history database which registers a jam frequency indicative of the frequency of past jam occurrence in the transport area where the jam has occurred. The storage section 32, which stores the jam history database functions as a jam history database storage unit which is included in the database storage unit 20. This step corresponds to the jam frequency calculation unit 14.

If a jam occurs, the processing section 30 increments the number of times of past jam occurrence which is stored in the jam history database by 1. Further, the latest jam frequency is calculated. The jam frequency is the number of times of jam occurrence per the number of transported print recording mediums. The jam frequency is updated for each transport area between the sensors 10 where a jam occurs. The number of transported print recording mediums may be calculated by a counter or the like provided in the transport path and stored in the storage section 32.

For example, when it is determined in Step S12 that a jam occurs between the sensor 10 (A1) and the sensor 10 (A2), the number of times of jam occurrence between A1 and A2 in the jam history database which is registered in the storage section 32 is incremented by 1. Further, the number of times of jam occurrence is divided by the number of transported print recording mediums to obtain the jam frequency. The obtained jam frequency is registered in the jam history database as the jam frequency between A1 and A2.

Deterioration of the transport device in the transport path between the sensors 10 may be determined on the basis of the number of times of jam occurrence or the jam occurrence frequency registered in the jam history database. For example, when the jam occurrence frequency exceeds a prescribed deterioration determination reference value, information which notifies the user of the deterioration of the transport device (transport roller or the like) in the relevant transport area may be displayed on the output section 36 or the like.

In Step S18, it is determined whether to change the sampling interval or not on the basis of the latest jam frequency between the sensors 10 calculated in Step S16. This step corresponds to the jam frequency comparison unit 16.

If the latest jam frequency between the sensors 10 is updated in Step S16, the processing section 30 compares the jam frequency with a jam frequency reference value between the sensors 10 which is stored and retained in advance in the storage section 32 as a reference database, and when the magnitude relation is changed as compared with previous comparison, progresses the process to Step S20. Otherwise, the processing section 30 returns the process to Step S10, and repeats the above-described processing. The storage section 32 which stores the reference database functions as a reference value database storage unit which is included in the database storage unit 20.

In Step S20, the switch processing of the sampling interval is performed. This step corresponds to the sampling interval changing unit 18.

The processing section 30 decreases the sampling interval of the sensors 10 corresponding to a transport area where the jam frequency starts to exceed the jam frequency reference value to set the temporal resolution of the relevant sensors 10 to be higher Further, the processing section 30 increases the sampling interval of the respective sensors 10 corresponding to a transport area where the jam frequency starts to fall below the jam frequency reference value registered in the reference value database to set the temporal resolution of the relevant sensors 10 to be lower.

For example, when the jam frequency of the transport area between the sensor 10 (A1) and the sensor 10 (A2) starts to exceed the jam frequency reference value of the transport area between the sensor 10 (A1) and the sensor 10 (A2) which is registered in advance in the reference value database, the sampling interval which is set to 10 ms in the initial setting is changed to 1 ms.

Figure 6:
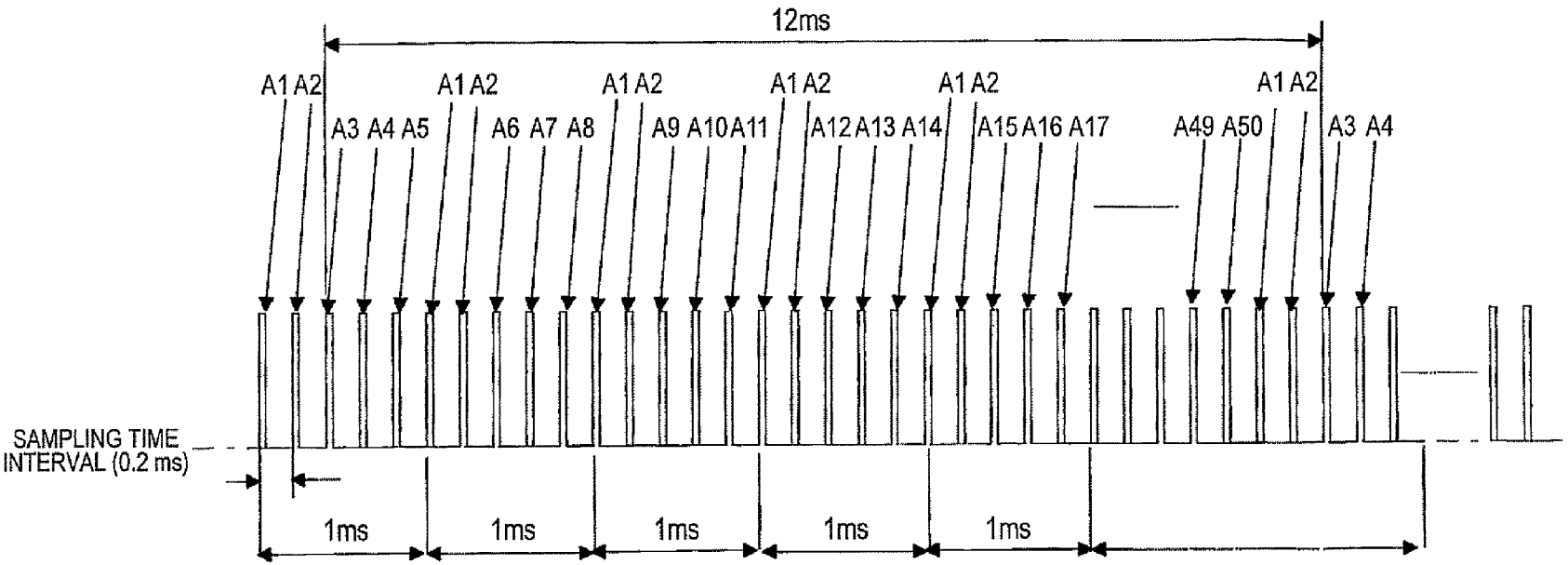
FIG. 6 is a diagram illustrating a processing for changing the sampling interval of a sensor.

Specifically, in the processing in which sampling of the respective sensors 10 is sequentially switched and performed every 0.2 ms, as shown in FIG. 6, sampling of the sensor 10 (A1) and the sensor 10 (A2) is inserted every 1 ms. That is, after the sampling of the sensor 10 (A1) and the sensor 10 (A2), sampling of the sensor 10 (A3), the sensor 10 (A4), and the sensor 10 (A5) is performed. Then, even though sampling of the sensor 10 (A6) has to be performed when the time 1 ms passes after the sampling of the sensor 10 (A1), but sampling of the sensor 10 (A6) is not performed, and sampling of the sensor 10 (A1) and the sensor 10 (A2) is performed again. Thereafter, sampling starts from the sensor 10 (A6), sampling of the sensor 10 (A1) and the sensor 10 (A2) is performed again every 1 ms after sampling of the sensor 10 (A1). In this way, sampling of the sensor 10 (A1) and the sensor 10 (A2) is inserted every 1 ms. Accordingly, the sampling intervals of the sensor 10 (A1) and the sensor 10 (A2) become 1 ms, and the sampling intervals of other sensors 10 become 12 ms.

The sampling intervals of the sensor 10 (A3) to the sensor 10 (A50) increase by 20% with respect to the initial state of FIG. 4, but the timing data collection system itself has a margin to some extent, and there is no great influence. The sampling intervals of the sensor 10 (A1) and the sensor 10 (A2) are changed from 10 ms to 1 ms, and the temporal resolution increases by ten times.

The jam frequency of the transport area between the sensor 10 (A1) and the sensor 10 (A2) starts to fall below the jam frequency reference value of the transport area between the sensor 10 (A1) and the sensor 10 (A2) which is registered in advance in the reference value database, the sampling interval which is set to 1 ms returns to 10 ms, as shown in FIG. 4.

Specifically, as shown in FIG. 4, the processing in which sampling of the respective sensors 10 is sequentially switched and performed every 0.2 ms is returned, so the sampling intervals of the sensor 10 (A1) and the sensor 10 (A2) return from 1 ms to 10 ms.

After the sampling interval is changed in such a manner, the process returns to Step S10, and the above-described processing is repeated.

<Second Exemplary Embodiment>

In the first exemplary embodiment, the change processing of the sampling interval of the sensors 10 is performed in accordance with the jam occurrence frequency between the sensors 10. In the second exemplary embodiment, the change processing of the sampling interval of the sensors 10 is performed in accordance with a prescribed sequence.

Figure 7:
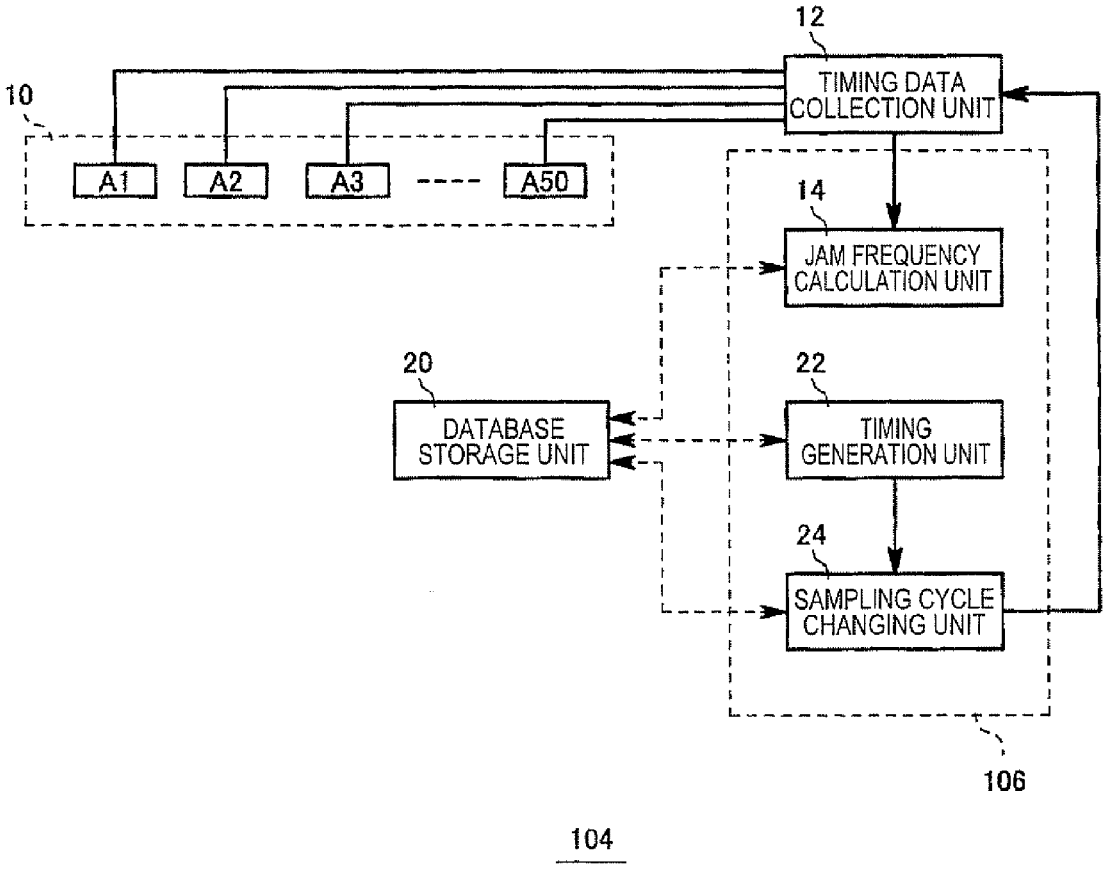
FIG. 7 is a diagram showing the configuration of a medium transport device according to a second exemplary embodiment.

As shown in FIG. 7, a medium transport device 104 according to a second exemplary embodiment includes a sensor 10, a timing data collection unit 12, a jam frequency calculation unit 14, a timing generation unit 22, a sampling interval changing unit 24, and a database storage unit 20. The medium transport device 104 is provided in an image forming apparatus, such as an electrophotographic print apparatus or the like, or a multi-function apparatus having the functions of a facsimile and a printer, or the like.

The jam frequency calculation unit 14, the timing generation unit 22, and the sampling interval changing unit 24 are included in the sampling resolution changing unit 106. The timing data collection unit 12, the jam frequency calculation unit 14, the timing generation unit 22, the sampling interval changing unit 24, and the database storage unit 20 of the medium transport device 104 are realized by a computer which is provided in an image forming apparatus, such as an electrophotographic print apparatus or the like, similarly to the first exemplary embodiment.

Figure 8:
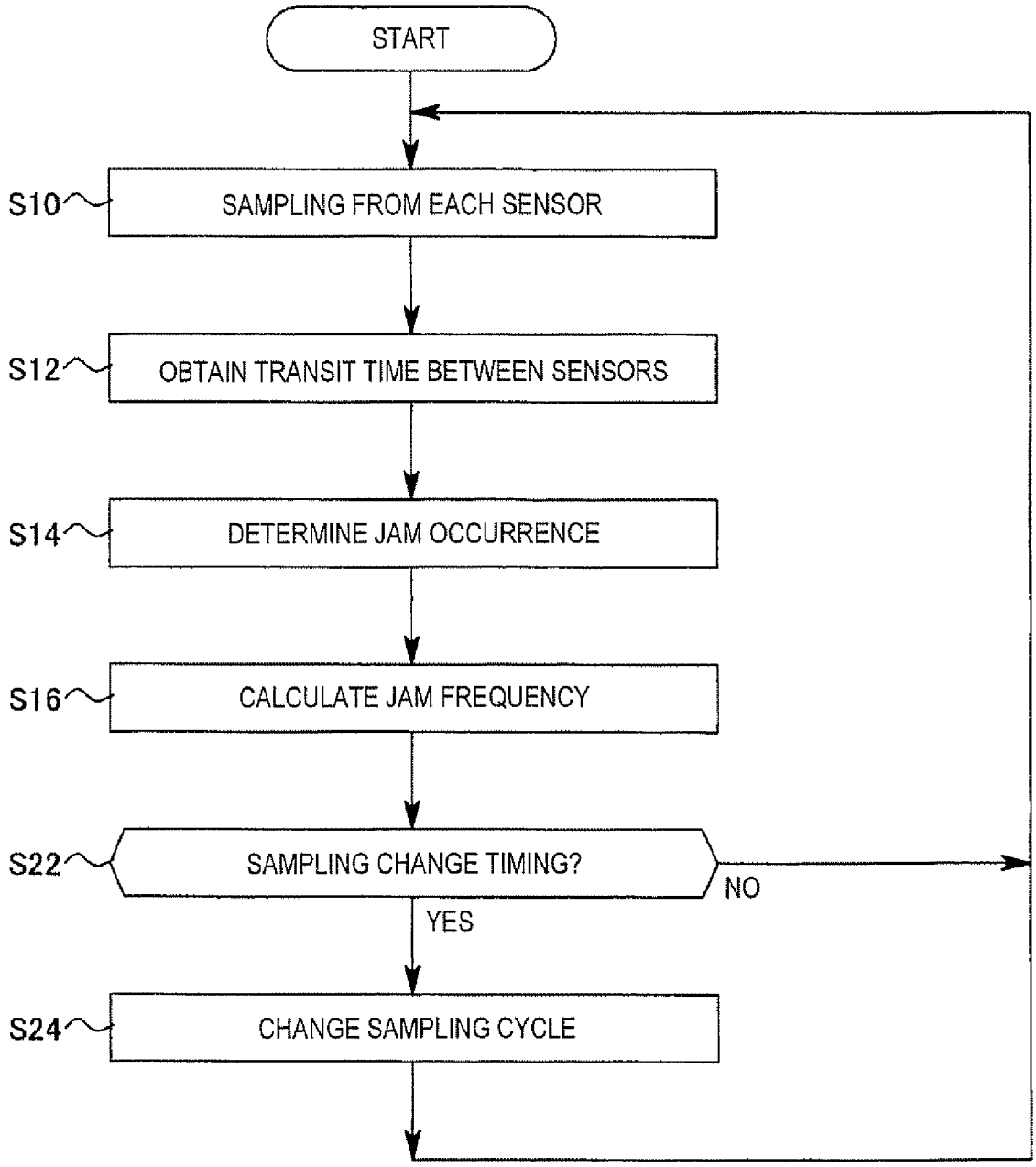
FIG. 8 is a diagram showing the configuration of a computer which realizes the medium transport device according to the second exemplary embodiment.

Hereinafter, control in the medium transport device will be described with reference to a flowchart of a control method for the medium transport device of FIG. 8. The processing section 30 executes a control program for the medium transport device which is recorded in advance in the storage section 32 to perform the following processing, and thus the respective units shown in FIG. 8 are realized. The same steps as those in the first exemplary embodiment are represented by the same reference numerals as those in FIG. 3, and descriptions thereof will be omitted.

In Step S10, the outputs of the respective sensors 10 are sampled. In Step S12, the time during which the print recording medium passes between the sensors 10 is obtained on the basis of the sampling signals from the respective sensors 10 obtained in Step S10. In Step S14, it is determined whether a jam of the print recording medium occurs in the transport path or not on the basis of the transport time obtained in Step S12. In Step S16, the jam frequency is calculated, and the update processing of the jam history database is performed. These steps are the same as in the first exemplary embodiment, and descriptions thereof will be omitted.

In Step S22, the timing for a switch processing of the sampling interval is generated. This step corresponds to the timing generation unit 22.

The processing section 30 measures the time elapsed from the start of the transport processing of the print recording medium by using an internal or external timer. The processing section 30 determines whether the timing for the switch processing of the sampling interval of each sensor 10 is reached for every time elapsed from the start of the transport processing of the print recording medium or not on the basis of a switch sequence of the sampling interval which is registered in advance in the storage section 32. When the timing for the switch processing of the sampling interval is reached, the process progresses to Step S24. Otherwise, the process returns to Step S10.

For example, when the switch sequence which is registered in the storage section 32 is designed to sequentially change the sampling interval at a prescribed time interval for every two sensors, the processing section 30 progresses the process to the sampling interval change processing of Step S24 each time a prescribed time passes from the start of the transport processing of the print recording medium.

In Step S24, the switch processing of the sampling interval is performed. This step corresponds to the sampling interval changing unit 24.

The processing section 30 decreases the sampling interval of each sensor 10 at a prescribed time interval in the storage section 32 to set the temporal resolution of the sensor 10 to be higher.

For example, when the switch sequence which is registered in the storage section 32 is designed to change the sampling interval of every two sensors 10 to 1 ms from the sensor 10 (A1) to the sensor 10 (A50) for every prescribed time interval (10 s), the process progresses to Step S24 when the time elapsed from the start of the transport processing of the print recording medium becomes 10 s. Thus, as shown in FIG. 5, the sampling intervals of the sensor 10 (A1) and the sensor 10 (A2) are first changed from the initial value, 10 ms, to 1 ms, and then the process returns to Step S10. In this state, therefore, sampling for only 10 s and the jam determination processing are performed.

Next, if the time 10 s has further passed, the process progresses to Steps S22 to S24, and the sampling interval of the sensor 10 (A1) is returned to 10 ms. Next, the sampling intervals of the sensor 10 (A2) and the sensor 10 (A3) are changed from 10 ms to 1 ms, and the process returns to Step S10. In this state, therefore, sampling for only 10 s and the jam determination processing are performed. Subsequently, if the time 10 s has passed, the sampling interval of the sensor 10 (A2) returns to 10 ms, the sampling intervals of the sensor 10 (A3) and the sensor 10 (A4) are next changed from 10 ms to 1 ms, and the process returns to Step S10.

This processing is repeated cyclically from the sensor 10 (A1) to the sensor 10 (A50). In this way, while the sampling intervals of the respective sensors 10 decrease sequentially, and the temporal resolution of sampling increases, the transport processing is performed along with the determination of jam occurrence or failure of the transport device.

Of course, the chance sequence of the sampling interval is not limited thereto. For example, the sampling interval of the sensor 10, which is provided at a position of the transport path where the transport device is liable to be deteriorated, may be set to be small preferentially. Further, the sampling interval of the sensor 10, which is provided at a position of the transport path where the transport device is liable to be deteriorated, may decrease to increase the frequency.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The exemplary embodiments were chosen and described in order to best explain the principles of the invention and its practical application, thereby enabling other skilled in the art to understand the invention for various exemplary embodiments and with the various modifications as are suited to the particular use contemplated. It is intended that the scope of the invention be defined by the following claims and their equivalents.

What is claimed is:

1. A medium transport device comprising:

a sensor unit having a plurality of sensors, the senor unit provided in a transport path of a print recording medium to detect a transport timing of the print recording medium;

a timing data collection unit that receives an output from the sensor unit and samples the output at a sampling interval as timing data; and a sampling resolution changing unit that changes the sampling interval, wherein the sampling resolution changing unit changes the sampling interval so that the sampling interval of each sensor of the plurality of sensors is different from each other, and under the condition that the sampling interval of a first group of the plurality of sensors decreases, the sampling interval of a remaining group of the plurality of sensors increases.

2. The medium transport device according to claim 1, wherein the sampling resolution changing unit changes the sampling interval in accordance with a jam frequency of the print recording medium.

3. The medium transport device according to claim 2, wherein the jam frequency is detected by using the timing data collected by the timing data collection unit.

4. The medium transport device according to claim 2, wherein the jam frequency is detected for each sensor of the plurality of sensors by using the timing data collected from the plurality of sensors by the timing data collection unit, and when the jam frequency exceeds a given reference value, the sampling resolution changing unit changes the sampling interval.

5. The medium transport device according to claim 1, wherein the sampling resolution changing unit changes the sampling interval in accordance with a given sequence.

6. A non-transitory computer readable medium storing a program, the program causing a computer to execute a process for controlling a medium transport device, the process comprising:

sampling outputs from a plurality of sensors provided in a transport path of a print recording medium at sampling intervals;

determining whether a jam of the print recording medium occurs in the transport path or not; and changing the sampling intervals of the plurality of sensors based on the determination so that the sampling intervals the plurality of sensors are different from each other, wherein under the condition that the sampling interval of a first group of the plurality of sensors decreases, the sampling interval of a remaining group of the plurality of sensors increases.

7. A method for controlling a medium transport device comprising:

sampling outputs from a plurality of sensors provided in a transport path of a print recording medium at sampling intervals;

determining whether a jam of the print recording medium occurs in the transport path or not; and changing the sampling intervals of the plurality of sensors based on the determination so that the sampling intervals the plurality of sensors are different from each other, wherein under the condition that the sampling interval of a first group of the plurality of sensors decreases, the sampling interval of a remaining group of the plurality of sensors increases, and the above steps are performed by a processor.

* * * * *